United States Patent [19]

Phillips et al.

[11] Patent Number: 4,949,661

[45] Date of Patent: Aug. 21, 1990

[54] MECHANICAL RUDDER STOPPERS

[75] Inventors: R. H. Phillips, Kings Beach; Ching Yiu, San Leandro, both of Calif.

[73] Assignee: Chevron Research Company, San Francisco, Calif.

[21] Appl. No.: 801,655

[22] Filed: Nov. 25, 1985

[51] Int. Cl.[5] ..... B63H 25/22

[52] U.S. Cl. ..... 114/170; 92/15

[58] Field of Search ..... 114/150, 172, 162, 144, 114/169, 170; 92/15, 17, 23

[56] References Cited

U.S. PATENT DOCUMENTS

| | | | |
|---|---|---|---|
| 3,662,653 | 5/1972 | Carlson et al. | 92/15 |
| 4,122,758 | 10/1978 | Bieringer | 92/15 |
| 4,373,851 | 2/1983 | Confoey | 92/23 |

FOREIGN PATENT DOCUMENTS

| | | | |
|---|---|---|---|
| 59336 | 1/1939 | Denmark | 114/150 |
| 1175574 | 8/1964 | Fed. Rep. of Germany | 114/150 |
| 1330240 | 12/1963 | France | 114/150 |
| 760863 | 11/1956 | United Kingdom | 114/150 |

*Primary Examiner*—Joseph F. Peters, Jr.
*Assistant Examiner*—Edwin L. Swinehart
*Attorney, Agent, or Firm*—Edward J. Keeling

[57] ABSTRACT

The present invention discloses a device for restricting the movement of a hydraulically actuated rudder assembly on a large ocean-going vessel during failure of the hydraulic system. It comprises a half-collar made of a material that is substantially incompressible along its lengthwise axis and is adapted to fit over a ram rod or a guide rod in a steering assembly between a cross-head and a ram rod sleeve or guide rod. The length of the half-collar is minimally less than the length between the cross-head and the terminus of the ram rod or guide rod when the rudder is in a neutral position.

10 Claims, 3 Drawing Sheets

MECHANICAL RUDDER STOPPERS

FIELD OF INVENTION

This invention generally relates to devices that are useful in controlling the steering of a marine vessel. Here, the preferred embodiment is designed to mechanically arrest the movement of a hydraulically powered steering assembly.

DESCRIPTION OF THE BACKGROUND ART

Large marine vessels are usually steered by large hydraulically operated rudders. This, of course, is nothing new, and some type of hydraulic rudder has been in existence at least since the patent to Christensen, U.S. Ser. No. 641,192, Jan. 6, 1906. However, these systems have been evolving into more complexed rudder assemblies which, in turn, rely more heavily on increasingly complex safety mechanisms. These large rudder assemblies, if they suffer a loss in hydraulic fluid, can render an large vessel completely helpless and at the mercy of the prevailing environmental forces. Furthermore, when there is a complete loss of hydraulic fluid, the rudder assembly may uncontrollably lash back and forth creating an extremely hazardous condition for those persons who are in the immediate vicinity of the device.

Safety mechanisms on large ocean-going vessels use systems that replenish the hydraulic fluid to the ram cylinders. For example, see U.S. Pat. Nos. 4,209,986; 3,949,696; and 3,913,517.

Other attempts at providing a secure hydraulic system are: blocking valves to block the hydraulic fluid in the ram cylinders (see *Reliability Improvements for Vessel Steering Systems*, page 6–1, U.S. Dept. Comm./NTIS, J. J. Henry Company, Incorporated, New York), or some type of mechanical stop, as shown in U.S. Pat. No. 3,818,853, and Norwegian Patent No. 33,429.

OBJECTS OF THE INVENTION

The present invention seeks to provide a device that may easily arrest the movement of the rudder in the event of a loss in fluid pressure to the hydraulic ram cylinders. It is a further object of this invention to create a device that may perform the above function simply and inexpensively.

SUMMARY OF THE INVENTION

The present invention is a device to arrest the movement of a hydraulically actuated rudder on a large ocean-going vessel. The device is essentially a half-collar made of a material that is substantially incompressible along its lengthwise axis and may fit over a guide rod or a ram rod in the steering assembly. When fit over a guide rod, or ram rod, the ends of the device abut the neighboring sleeve and cross-head and thereby restrict the sleeve from sliding along the rod. The sleeves are immobilized from moving once a pair of devices are fit over opposing guide rods or ram rods to restrict the rudder assembly.

DETAILED DESCRIPTION OF THE INVENTION

Figure 6:
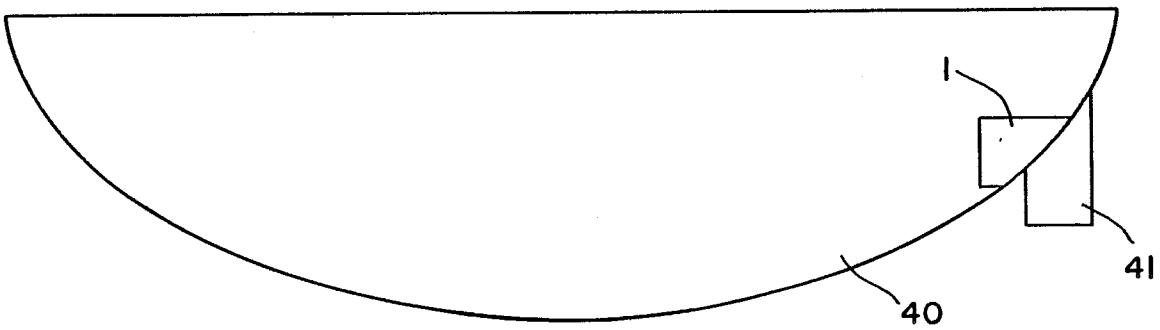
FIG. 6 is a side veiw of an ocean-going vessel.

FIG. 6 shows an ocean-going vessel 40, with a rudder 41 and a steering assembly 1.

Figure 1:
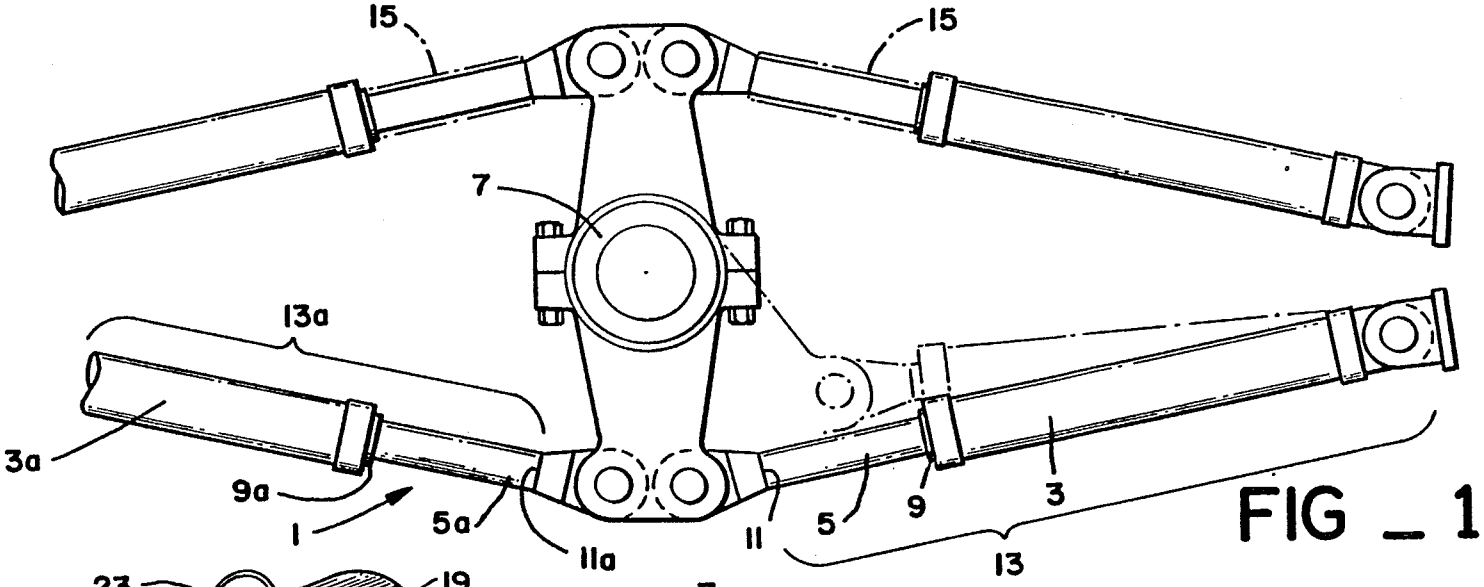
FIG. 1 is an overhead view of a hydraulic steering system.

The present invention is a mechanical rudder stopper for large marine vessel steering systems when they suffer a loss in hydraulic fluid. Now, referring to the drawings, FIG. 1 shows a typical steering assembly 1 for a vessel of 35,000 DWT such as the Chevron Oregon. Assembly 1 may be further broken down into a ram cylinder 13, a main ram sleeve 3, a main ram rod 5, and a cross-head 7 with armature 42. Sleeve 3 has a load-bearing surface 9 and cross-head 7 has a load-bearing surface 11 (the opposing members are shown by the designation "a" after the corresponding reference numeral).

Figure 2:
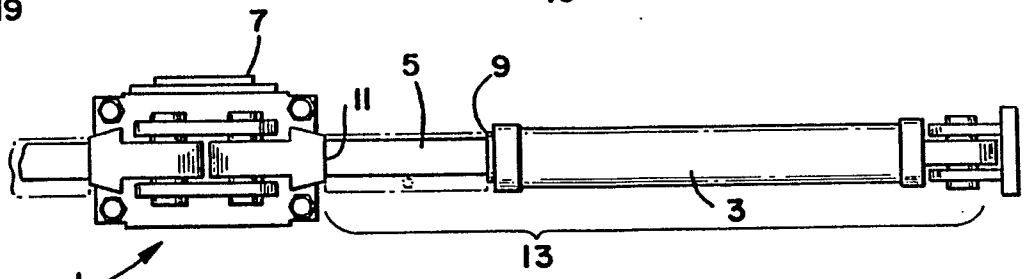
FIG. 2 is a sideways view of a hydraulic steering system as shown in FIG. 1.

FIG. 2 shows a sideways view of the steering assembly 1 with all the above referenced components in place.

Figure 3:
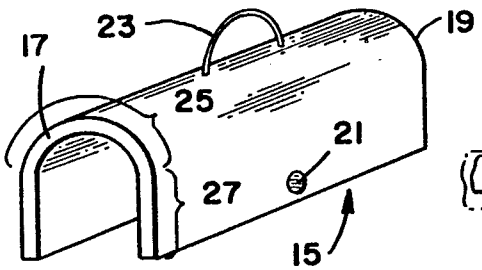
FIG. 3 is a view of a rudder stopper device.

FIG. 3 shows a enlarged view of the stopper 15. Stopper 15 comprises a U-shaped collar that fits over the ram rod 5 (as shown in phantom FIGS. 1, 2, 4, and 5). It has two end bearing surfaces 17 and 19, an aperture 21 for a securing pin, and a handle 23. The U-shaped or curved portion of the device is designated by referenced numeral 25 and the flat portion by referenced numeral 27.

Figure 4:
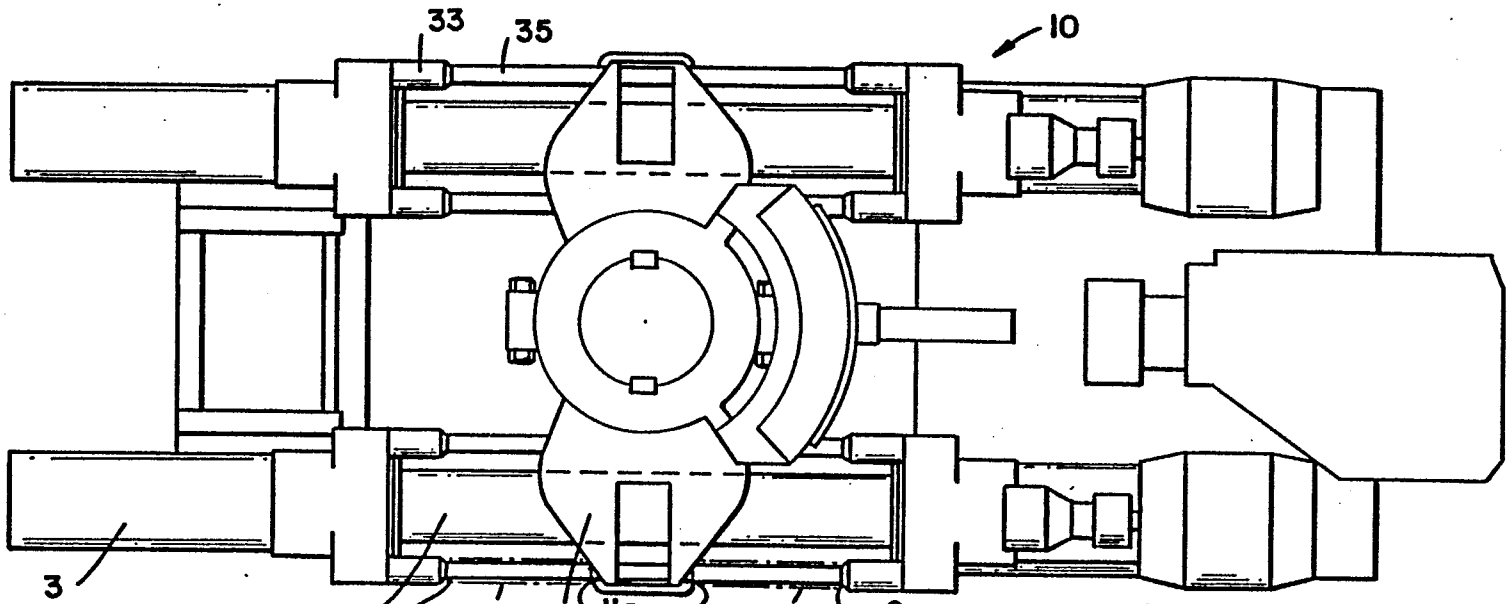
FIG. 4 is an overhead view of a larger hydraulic steering system than the device of FIG. 1.

FIG. 4 is a typical steering assembly 10 on a larger vessel than FIG. 1, for example, a vessel such as the Cheveron California, which is 70,000 DWT. Here, as in the device of FIG. 1, there is: a ram sleeve 3, a ram rod 5 (which make up a ram cylinder 13), and a cross-head 7. However, there is the addition of a guide rod sleeve 33 and a guide rod 35.

Figure 5:
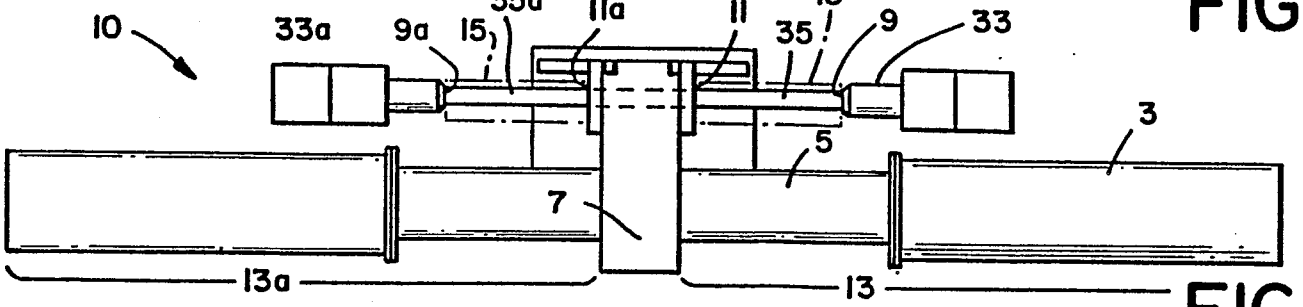
FIG. 5 is a sideways view of the device of FIG. 4.

As shown in FIG. 5, there is a proper load-bearing surface on the guide rod sleeve 9 as well as on the cross-head 11. FIG. 5 is a side view of the device of FIG. 4.

The steering assemblies of FIGS. 1 and 4 selectively admit and expel hydraulic fluid into a ram cylinder 13 or 13*a*. This causes the ram rod 5 to either move in or out of the ram sleeve 3 which causes cross-head 7 to turn and consequently move the rudder. A secondary effect of this in and out movement is that the distance between the cross-head surface 11 and the sleeve surface 9 is either shortened or increased as shown in phantom on FIG. 1. It is in this area that the present device operates. The steering assembly 10 of FIG. 4 operates in much the same way. However, the ram cylinder 13 does not articulate, and the device adds a guide rod 35 with a guide rod sleeve 33. The guide rod 35 and sleeve 33 hold the ram cylinder 13 in place and limit the extraneous movement of the cross-head 7.

In both steering systems 1 and 10, a mechanical rudder stopper 15 may be inserted between the cross-head surface 11 and the sleeve surface 9 to prohibit the movement of the ram rod 5 into ram sleeve 3. The rudder stopper 15 may be inserted when the opposing ram rod 5 is moved out of its ram sleeve 3 in the device of FIG. 1 or FIG. 4.

The dimensions of the present stopper 15 (as used on the Chevron California, i.e., FIGS. 4 and 5) are $18\frac{3}{4}$ inches along the lengthwise axis, $\frac{7}{8}$ inches thickness at the U-shaped portion 25, and $\frac{3}{4}$ inches thickness at the flat portion 27. The length of the flat portion 27 is $4\frac{3}{4}$ inches and the internal diameter of the collar 15 itself is the external diameter of the guide rod 35 (that the collar 15 is designed to fit over) plus approximately 1/16 inch. Obviously, the dimensions will vary with the size of the steering gear system.

The collars (or stoppers) 15 may be used in the following manner. (Other uses may be made of the present invention, to immobilize the rudder assembly in dry dock while workers repair the hydraulic system, etc.) Once the steering assembly 1 loses the hydraulic fluid, the rudder may move from side to side in an uncontrollable fashion, which will cause the ram rods 5 to move in and out of the ram sleeves 3 also in an uncontrollable fashion. When this happens, a crewman aboard the vessel may take the collar 15 (usually by the handle 23) and deploy it over ram rod 5, or guide rod 35, whose exposed length between stop 11 and terminus 9 is at least as long as the collar 15. He may then fix it in place with a securing pin set through the aperture 21. When the rudder is moved, the distance between the end-bearing surfaces 9 and 11 is lengthened which allows the rudder stopper 15 to be put into position. Once the stopper 15 is in place, it restricts movement of the rudder in one direction only. However, to restrict the movement of the rudder in the other direction, another (identical) stopper 15 is put in place on an opposing ram rod 5*a*, or guide rod 35*a*, when there is enough room between end-bearing surfaces 9*a* and 11*a* for the stopper 15. A crewman places the stopper 15 on the opposing rod 5*a* or 35*a* when the rudder swings back in the other direction to compress the ram rod 5 (which then lengthens the distance between 9*a* and 11*a*). (The length of the collar 15 has been previously determined to be no longer than the length between the cross-head surface 11 and the sleeve surface 9 when the rudder is in a neutral position, i.e., that being the position where the distances between the cross-head surface 11 and the sleeve surface 9 is equal for both opposing rams.) Once the crewman deploys the collar 15 for both opposing ram cylinder assemblies 13 and 13*a*, the rudder may not move either way because each ram cylinder 13 and 13*a* may not move in or out due to the blocking of the collar 15 that is placed over the ram rod 5 and 5*a* or guide rod 35 and 35*a*. At this point, the uncontrollable movement of the rudder has been neutralized and the vessel may be controlled by other means.

The stoppers 15, if they are fit on a rudder system for a vessel that is different from the Chevron California class, would have to be modified slightly to work properly. For example, the stoppers 15 that may be used on the Chevron Oregon class are formed of 2 pieces because a one-piece stopper 15 would be too heavy. Furthermore, when a stopper 15 is applied over a ram rod 5, there is a danger of scratching the surface of the ram rod 5 which would cause a loss in hydraulic fluid. So, to cure this problem, a protective, soft surface may be applied to the inside surface of the stopper 15 to prevent scratching the ram rod 5. And lastly, the end-bearing surfaces of the stopper 15 would have to be modified slightly to accommodate the particular configuration of this rudder system 1. Basically, the stopper 15 should mechanically immobilize the rudder by the placement of some imcompressible object over a guide 35 or ram rod 5 to prevent the respective sleeve (33 or 3) from increasing or decreasing in distance from the cross-head 7.

Since many modifications and variations of the present invention are possible within the spirit of this disclosure, we intend that the embodiments disclosed are only illustrative and not restrictive. For that reason, we refer to the following claims rather than to the specific description to indicate the scope of this invention.

What is claimed is:

1. A device for arresting the movement of a hydraulically actuated rudder on a large ocean-going vessel, comprising:
   - an ocean-going vessel;
   - a rudder for controlling said vessel;
   - a cross-head fixedly connected to the rudder;
   - at least one radially extending armature on said cross-head;
   - at least two opposing ram rods pivotally attached to said radially extending armature on said cross-head to turn which will likewise turn said rudder;
   - a load-bearing surface on said radially extending armature at the point of attachement of each of said ram rods;
   - a ram rod sleeve slidably fit around each of said ram rods;
   - a load-bearing surface on each of said ram rod sleeves at the point that the ram rod extends out os said ram rod sleeve; and
   - at least two half-collars each of said half-collars adapted to fit over each of said ram rods between the load-bearing surface of the cross-head and the load-bearing surface of the ram rod sleeve, having a width that is minimally larger than said ram rod and a length that is minimally shorter than the distance between the load-bearing surfaces of the cross-head and the ram rod sleeve when the rudder is placed in a position for neither right or left turning, said half-collar being substantially incompressible along its lengthwise axis.

2. The device as recited in claim 1 where each of said half-collars has a means to affix said half-collar to said ram rod.

3. The device as recited in claim 1 where a protective surface is applied to the collar on the surface that contacts the ram rod.

4. The device as recited in claim 3 where each of said half-collars has a means to affix said half-collar to said ram rod.

5. A device for arresting the movement of hydraulically actuated rudder on a large ocean-going vessel, comprising:
   - a rudder for controlling an ocean-going vessel;
   - a cross-head fixedly connected to the rudder;
   - at least one radially extending armature on said cross-head;
   - at least two opposing ram rods fixedly attached to said radially extending armature on said cross-head so that extension of either of said ram rods will cause said cross-head to turn which will likewise turn said rudder;
   - ram rod sleeves slidably fit around each of said ram rods;
   - guide rods slidably fit through said cross-head armature;
   - at least two guide rod sleeves slidably fit around each of said guide rods, said guide rod sleeves being attached to said ram rod sleeve in a parallel relationship;

a load-bearing surface on each of said guide rod sleeves at the point that the guide rod extends out of said guide rod sleeves;

a load-bearing surface on said cross-head armature at the point that the guide rod slidably fits through said cross-head armature;

at least two half-collars adapted to fit over each of said guide rods between the load-bearing surfaces of the cross-head and the guide rod sleeve, each half-collar having a width that is minimally larger than said guide rod and length that is minimally shorter than the distance between the load-bearing surfaces of the cross-head and the guide rod sleeve when the rudder is in a position that steers the vessel to neither the right or the left, said half-collar being substantially imcompressible along its lengthwise axis.

6. A device for arresting the movement of a hydraulically actuated rudder in an emergency situation on an ocean-goind vessel comprising:

an ocena-going vessel;

a rudder for controlling said vessel;

a cross-head fixedly connected to said rudder;

a radially extending armature operably mounted to said cross-head;

tow or more opposing ram rods pivotally attached to said armature, such that extension of said ram rods will cause said cross-head and said rudder to turn;

ram rod sleeves slidably mounted to said ram rods opposite said armature;

ram load-bearing surfaces on said ram rod sleeves substantially near said ram rods;

armature load-bearing surfaces on said armature substantially near said ram rods; and half-collars adapted to fit over said ram rods between said armature load-bearing surfaces and said ram load-bearing surfaces when said rudder is in a substantially straight position, said half-collars made of an incompressible material and further comprising a quick hold-on means.

7. Apparatus as recited in claim 6 wherein said quick hold-on means further comprises:

an aperture in said half-collar; and a pin.

8. Apparatus as recited in claim 6 further comprising a protective surface on said half-collar applied at the point where said half collar contacts said ram load-bearing surface and said armature load-bearing surface.

9. A method for arresting the movement of a hydraulically operated rudder on an ocean going ship comprising the steps of:

inserting two or more half-collars between load-bearing surfaces of a slidable member in a hydraulic rudder; and engaging a quick hold-on device on said half-collar.

10. Apparatus as recited in claim 9 wherein the step of engaging a guide hold-on device further comprises sliding a pin adapted to fit in apertures in said half-collar.

* * * * *